United States Patent [19]

Fette

[11] 4,378,469

[45] Mar. 29, 1983

[54] HUMAN VOICE ANALYZING APPARATUS

[75] Inventor: Bruce Fette, Mesa, Ariz.

[73] Assignee: Motorola Inc., Schaumburg, Ill.

[21] Appl. No.: 267,204

[22] Filed: May 26, 1981

[51] Int. Cl.[3] ..... G10L 1/00

[52] U.S. Cl. ..... 179/1 SA; 364/728; 179/1 D

[58] Field of Search ..... 179/1 SA, 1 SM, 1 D; 364/724, 728, 513

[56] References Cited

U.S. PATENT DOCUMENTS

| | | | |
|---|---|---|---|
| 3,662,115 | 5/1972 | Saito et al. | 179/1 SA |
| 4,052,563 | 10/1977 | Noda et al. | 179/1 SA |
| 4,340,781 | 7/1982 | Ichikawa et al. | 179/1 SA |

FOREIGN PATENT DOCUMENTS 2026289 1/1980 United Kingdom .

OTHER PUBLICATIONS

Bodley, N., "Here's a Breakthrough . . . ", Electronic Design, Jul. 19, 1978.

*Primary Examiner*—Emanuel S. Kemeny
*Attorney, Agent, or Firm*—Eugene A. Parsons

[57] ABSTRACT

The analyzing apparatus includes a ten stage, all-zero lattice digital filter formed on a single semiconductor chip. A partial correlation coefficient is derived in each stage of the lattice filter in improved coefficient circuitry and the analyzer provides the ten partial correlation coefficients, for a best sample from a plurality of samples, along with the amplitude (R.M.S.), and the residual energy, or the excitation. The correlator uses the products FB, $F^2$ and $B^2$, of the residual F and B signals.

15 Claims, 8 Drawing Figures

HUMAN VOICE ANALYZING APPARATUS

BACKGROUND OF THE INVENTION

Linear predictive coding (LPC) is one of the more important tools used in the processing of voice information. LPC is a mathematical procedure for estimating a filter function equivalent to the vocal tract. The estimate of the vocal tract resonance may be used to subtract vocal tract resonances from speech leaving an estimate of the excitation. The vocal tract function is estimated by removing correlation between a number of adjacent samples of the speech waveform; assuming that the waveform may be modeled as exponentially decaying sinusoids. The model for decaying sinusoids may be derived by inverting a correlation matrix (an all-pole lattice digital filter) to provide an all-zero lattice digital filter. The LPC correlation, excitation, and amplitude information are each individually quantized and transmitted typically at between 1200 and 4800 bits per second depending on desired speech fidelity, system complexity, and system throughput constraints.

The bandwidth of the LPC digital voice system is set by the number of bits used to describe each measured parameter and the frequency with which this snapshot of the articulators is updated. Predicter coefficients are usually transformed to reflection coefficients before quantization, because reflection coefficients have the nice property of being bounded between the natural limits of $+1$ and $-1$. Additionally, the first few reflection coefficients have the most predominant effect on the spectrum and thus can be quantized more finely than higher numbered reflection coefficients. For example, the first reflection coefficient is quantized with six bits while the last reflection coefficient may be quantized with only three bits.

While LPC analysis is computationally quite lengthy, it is mathematically straight-forward. The partial correlation analyzer of the present invention generates a new estimate of each reflection coefficient for each new speech sample.

Lattice structured approaches to LPC provide not only reflection coefficients which result in stable synthesis filters, due to their boundedness, but also provides the residual in a computational procedure which is elegantly simple. The partial correlation procedure for the lattice inverse filter consists of keeping a smooth estimate of the partial correlation between forward and backward transverse waves in the electrical analog vocal tract. These partial correlations relate directly to the reflection coefficients at hypothetical boundaries of a sectioned vocal tract. While it is possible to use general purpose processor approaches to the partial correlation procedure, even with a high performance arithmetic logic unit which could perform fast multiplies, adds, divides, subtracts, shifts, etc., and with very dense memory, power dissipation rapidly becomes prohibitive. Interconnects require a great deal of power consumption to charge and discharge the interconnect capacitance at the system clock rate. Thus a great deal of power is consumed.

SUMMARY OF THE INVENTION

The present invention pertains to partial correlation voice analyzing apparatus incorporating an all-zero lattice digital filter having N stages for deriving N partial correlation coefficients, each stage of said lattice filter including digital multiplying means for receiving a pair of forward residual and backward residual signals and providing a first output signal representative of the forward residual signal multiplied by the backward residual signal, a second output signal representative of the forward residual signal multiplied by itself, and a third output signal representative of the backward residual signal multiplied by itself, signal combining means connected to receive the second and third output signals from said multiplying means for providing a sum signal representative of the sum of the second and third output signals, or some portion thereof, digital filtering means connected to receive the first output signal for providing a numerator signal and connected to receive the sum signal from said combining means for providing a denominator signal, digital dividing means connected to receive the numerator and denominator signals for providing an output signal representative of the quotient of the two received signals and digital filtering means connected to receive the output signal of said dividing means for providing an output signal representative of one of the end correlation coefficients.

In the preferred embodiment the analyzing apparatus is formed on a very large scale integrated (VLSI) chip as a single integrated circuit. The integrated circuit actually includes a single multiplier, divider, and add-/subtract circuit with a plurality of temporary storage units and sequencing circuitry to cause the included circuits to operate as if an N stage all-zero lattice filter were included on the chip.

It is an object of the present invention to provide partial correlation analysis apparatus on one VLSI chip, including all required ALUs, memory, and control, to minimize high frequency interpackage signaling and substantially reduce power dissipation.

It is a further object of the present invention to provide voice analyzing apparatus which is simplified in operation to reduce the overall required functions or apparatus.

It is a further object of the present invention to provide voice analyzing apparatus on a VLSI chip which includes a testing function for completely testing the chip externally.

These and other objects of this invention will become apparent to those skilled in the art upon consideration of the accompanying specification, claims and drawings.

BRIEF DESCRIPTION OF THE DRAWINGS

Referring to the drawings.

DESCRIPTION OF THE PREFERRED EMBODIMENT

Figure 1:
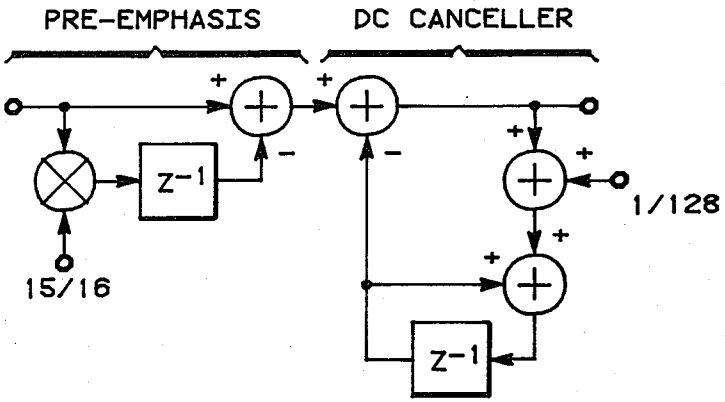
FIG. 1 is a flow diagram of a pre-emphasis circuit and a DC canceller used in the apparatus.

Referring to FIG. 1, a specific pre-emphasis circuit and DC canceller are illustrated for use with the voice analyzing apparatus. It will of course be understood by those skilled in the art that these circuits are used to operate on the voice signals prior to analysis to enhance the operation and the specific circuits illustrated might be altered, eliminated, or other and additional circuits might be added.

Figure 2:
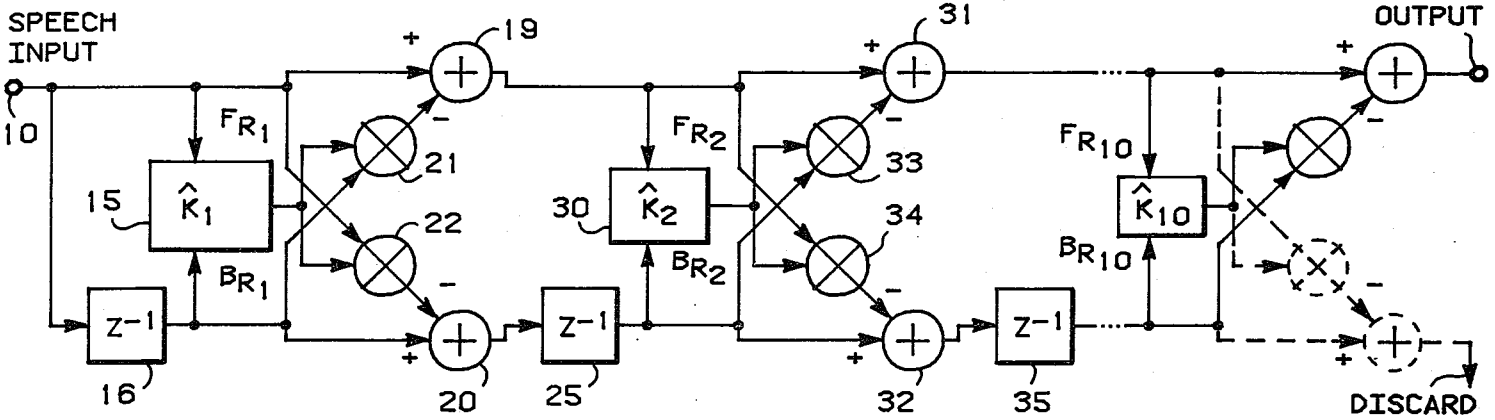
FIG. 2 is a flow diagram of voice analyzing apparatus embodying the present invention.

Referring specifically to FIG. 2, a flow diagram, or an all-zero lattice digital filter, for voice analyzing apparatus is illustrated. A speech input signal, which consists of a digital signal formed by periodically sampling speech, is applied to an input terminal 10. The input terminal 10 is connected directly to one input of a first correlation coefficient deriving circuit 15 and through a one sample delay 16 to a second input of the circuit 15. The direct connection from the terminal 10 to the circuit 15 carries a signal referred to as a forward residual ($F_R$) signal and the connection from the delay network 16 carries a signal referred to as the backward residual ($B_R$) signal. Because the lattice filter is formed of a plurality of stages and because each stage has forward residual and backward residual input signals, the signals applied to the circuit 15 have the subscript 1 affixed thereto to denote that they are the first forward residual and backward residual signals and the circuit 15 derives a correlation coefficient, $K_1$, where the subscript 1 denotes that it is the first coefficient.

In addition to the circuit 15, the first stage of the lattice filter also includes first and second combining circuits 19 and 20, first and second multipliers 21 and 22, and a one sample time delay network 25. The input terminal 10 is connected directly to a plus input of the combining circuit 19 and to one input of the multiplier 22. The signal $B_R$ from the delay network 16 is connected directly to a pulse input of the combining circuit 20 and to one input of the multiplier 21. The output of the correlation coefficient deriving circuit 15 is connected to a second input of the multiplier 21 and to a second input of the multiplier 22. The output of the multiplier 21 is connected negatively to the combining circuit 19 so as to be subtracted from the forward residual signal applied thereto on the other input. The output of the multiplier 22 is connected negatively to the combining circuit 20 so as to be subtracted from the backward residual signal applied to the other input thereof. The output of the combining circuit 19 is the forward residual signal, $F_{R2}$, applied to the second stage and the output of the combining circuit 20 is applied through the delay network 25 to the second stage as the backward residual signal, $B_{R2}$.

The second stage of the lattice filter includes a correlation coefficient deriving circuit 30 similar to the circuit 15, two combining circuits 31 and 32, two multipliers 33 and 34, and a one sample delay network 35 all connected as described in conjunction with the first stage. Similarly, stages 3 through 9 (not shown) are identical to stage 1. A tenth stage is illustrated with the parts and connections identical with stage 1, except that the backward residual signal is discarded and, thus, the multiplier, combining circuit and connections thereto which derive the final backward residual signal are illustrated in broken lines to indicate that they can be eliminated from the apparatus. The forward residual signal from the other combining circuit is an output of the apparatus and represents the excitation required (in conjunction with the ten correlation coefficients) to produced the speech sample applied to terminal 10.

The lattice filter illustrated by FIG. 2 is an all-zero lattice filter which is essentially the reverse of an electrical equivalent circuit for a human vocal tract. While the lattice filter of FIG. 2 includes ten stages, it will be understood by those skilled in the art that more or less stages might be utilized and ten stages are illustrated simply because they provide the required analysis of the human voice with a minimum of apparatus.

Figure 3:
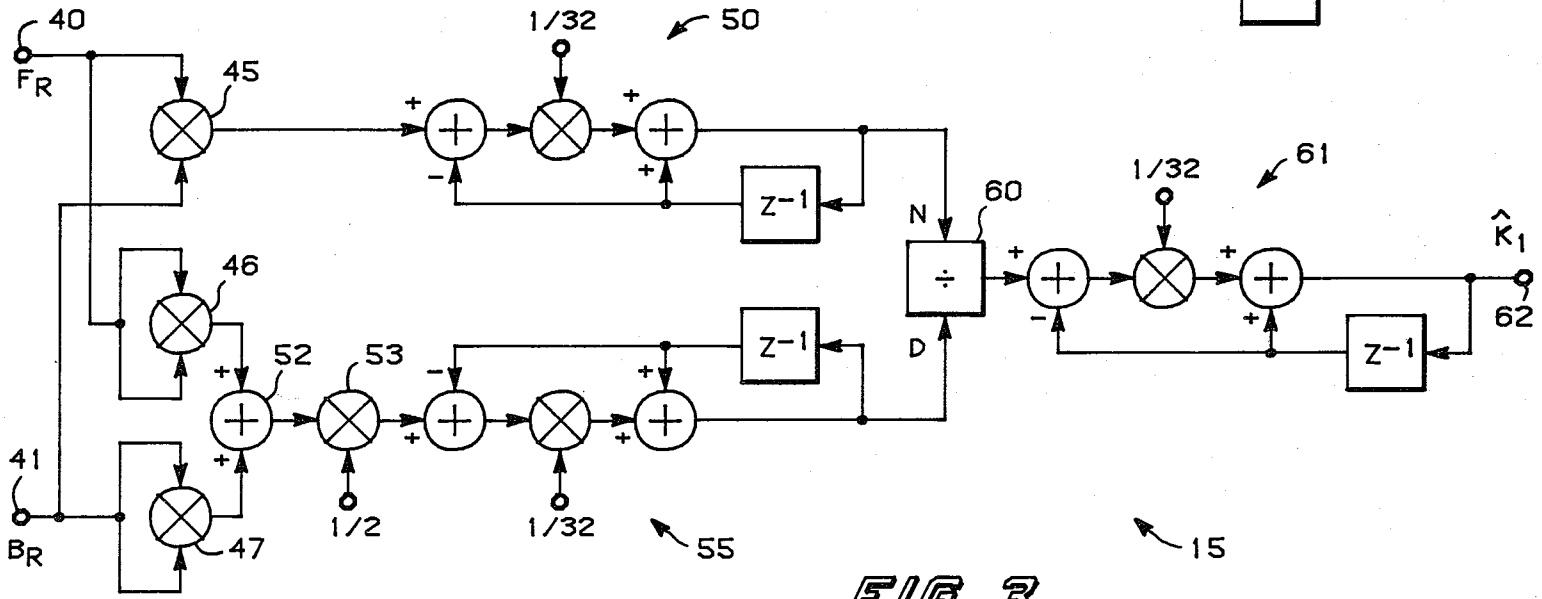
FIG. 3 is a more detailed flow diagram of a portion of FIG. 2.

The specific correlation coefficient deriving circuitry utilized in the present embodiment is illustrated in FIG. 3. Since each of the correlation coefficient deriving circuits are identical in each of the ten stages of the lattice filter of FIG. 2, only the first circuit 15 is illustrated in FIG. 3. The correlation coefficient deriving circuit 15 of FIG. 3 includes a first terminal 40 adapted to receive a forward residual signal ($F_R$) thereon and a second terminal 41 adapted to receive a backward residual signal ($B_R$) thereon. The input terminal 40 is connected directly to one input of a multiplier 45 and to both inputs of a second multiplier 46. The input terminal 41 is connected to a second input of the multiplier 45 and to both inputs of a third multiplier 47. The product output ($F_R.B_R$) of the first multiplier 45 is connected to a digital filter, generally designated 50. The product output ($F_R.F_R$) of the multiplier 46 is connected to one input of a combining circuit 52 and the product output ($B_R.B_R$) of the multiplier 47 is connected to a second input of the combining circuit 52. The combining circuit 52 adds the two product outputs and supplies the sum through a circuit 53, designed to reduce the sum by one-half, to a digital filter 55. In the embodiment illustrated the circuit 53 is a multiplier having a signal representative of 0.5 applied to one input so that the sum input from the combining circuit 52 is multiplied by one-half. It will of course be understood by those skilled in the art that digital signals may be manipulated by shifting to provide the division and the specific circuitry illustrated in FIG. 3 simply is utilized to illustrate the final result.

The filtered output signal from the filter 50 is applied to a numerator input of a divider 60. The filtered output signal from the filter 55 is applied to a denominator input of the divider 60 and the quotient output of the divider 60 is applied through a digital filter 61 to an output terminal 62. The filtered output signal at the terminal 62 is the correlation coefficient, or an estimation of the coefficient, for the specific circuitry illustrated. Each of the digital filters 50, 55 and 61 are illustrated as a specific type of infinite impulse response digital low pass filter, the operation of which is well known in the art. It will be understood by those skilled in the art, that other types of digital filters might be utilized and the present filters are illustrated for convenience and because of their simplicity.

In the present embodiment, the speech is sampled at a rate of 8000 samples per second and 180 samples are utilized as a frame. The circuitry disclosed in FIGS. 2 and 3 provides ten correlation coefficients per sample and the most accurate ten correlation coefficients are selected in each 180 sample frame to represent the entire frame. Each correlation coefficient is defined generally by the following statement:

$$\frac{\sum_{n=1}^{180} F_{RN} \cdot B_{RN}}{.5\left[\sum_{n=1}^{180} F_{RN}^2 + \sum_{n=1}^{180} B_{RN}^2\right]}$$

Figure 4:
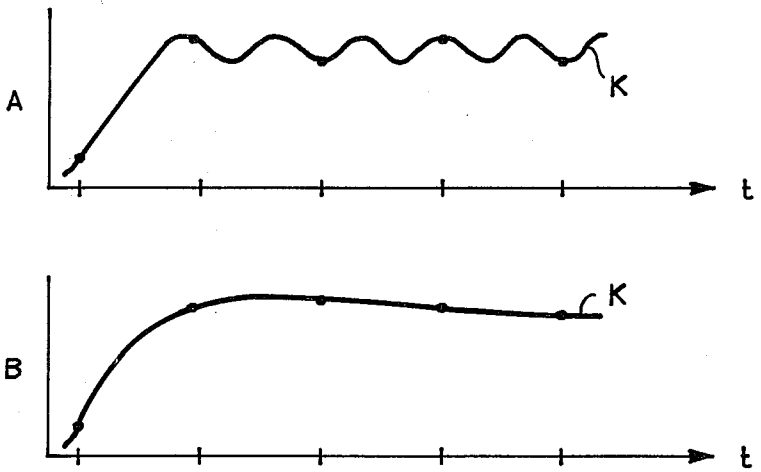
FIG. 4A is a graphical representation of an unfiltered partial correlation coefficient.
FIG. 4B is a graphical representation of a filtered partial correlation coefficient.

It will generally be recognized that the statement can be performed electrically by low pass filtering the product $F_R \times B_R$ to produce a numerator and low pass filtering one-half the sum of $F_R^2 + B_R^2$ to produce a denominator. The numerator is then divided by the denominator to provide the correlation coefficient. In the circuit illustrated in FIG. 3 the third low pass filter 61 is utilized to filter the output of the divider 62 to reduce noise and improve the output. It has been found that filtering after division reduces the amount of circuitry and the number of bits being operated upon. Also, by including the filter 61 after the divider 60 the filter 61 acts as an anti-aliasing filter to prevent getting the wrong sample of the 180 samples during down sampling. This can be understood by referring to FIG. 4. FIG. 4A illustrates a correlation coefficient which is unfiltered subsequent to the dividing process. It can be seen that the coefficient appears to be changing when in fact it is constant. FIG. 4B illustrates the correlation coefficient which is filtered subsequent to the division process. The filtered coefficient appears constant so that the best sample out of the 180 sample frame can be selected. The best sample is the one out of 180 samples in a frame, neglecting the first sample, with the lowest amplitude and the longest time between impulses.

The voice analyzing apparatus illustrated in FIGS. 2 and 3 could be constructed as illustrated with each of the illustrated circuits performing only the function specified. However, substantially smaller amounts of apparatus can be utilized with each part being utilized for a variety of purposes through proper sequencing. An embodiment utilizing a single multiplier, a single divider, a single adder/subtractor, and a plurality of temporary storage units is disclosed in FIG. 5. More specifically, FIG. 5 includes a twelve line input bus 65 connected to an A to D input buffer 66 and a bus driver 67. The A to D input buffer 66 is connected to twelve lines of a twenty-nine line data bus 70. The bus driver 67 is connected to an eleven line control bus 71. A control circuit 73 receives control signals from the control bus 71 and supplies control signals to the input buffer 66 as well as to jump decision logic 75. The control circuit 73 receives a "conversion complete" signal on an input 76 and supplies a "data taken" signal on an output 77. The jump decision logic 75 is interconnected with a counter 80 designed to count microcode steps supplied to the circuitry and determine when a jump in logic is required. The jump decision logic 75 also supplies signals to a sequence counter 81 which is reset each time power is supplied by a signal at a power on reset input 82. The sequence counter 81 supplies control signals to a sequence ROM (read only memory) 83 which in turn supplies control signals to a pipe register 85. The register 85 is connected to the control bus 71 by eleven lines which are generally utilized to control operation of the circuitry to be described.

A test signal input 86 is supplied, which input is connected to the bus driver 67 and to the pipe register 85. When a test signal is applied to the input 86 the previously described control circuitry is shut off and test signals are supplied directly to the control bus 71 for testing the operation of the various circuits. The test signal input 86 incorporates in the apparatus of FIG. 5 the ability to test the operation of the entire apparatus prior to usage of the apparatus or at periodic intervals to ensure the continuous proper operation of the apparatus.

A multiplier 90 has X and Y input registers each connected by twelve input lines to the data bus 70 and a product output register connected to the data bus 70 by twenty-four lines. The multiplier 90 is controlled by a control circuit 91 which in turn receives control signals from the control bus 71. The multiplier 90, in this embodiment, is a four-by-twelve multiplier which is clocked three times to provide a twelve-by-twelve multiplying function. The use of a four-by-twelve multiplier is somewhat slower than a twelve-by-twelve multiplier but the amount of chip space utilized is substantially reduced. The multiplier 90 has the additional feature that once the multiplication process has begun a new signal can be clocked into the X input register without disrupting the ongoing multiplication process.

A divider 93 has numerator and denominator input registers connected to the data bus 70 by twenty-four lines each and a quotient output register connected to the data bus by twelve lines. The divider 93 is controlled by a control circuit 94 which is in turn controlled by means of a connection to the control bus 71. The divider 93 may be, for example, a divider similar to that disclosed in copending U.S. patent application Ser. No. 211,009, filed Nov. 28, 1980 and entitled "High Speed Digital Circuitry".

An adder/subtractor 96 has an A input register and a B input register each connected to the data bus 70 by twenty-nine lines. The A input register has the option of using only the magnitude (absolute value) of the input, which value is obtained through the use of a bank of exclusive OR circuits. The B register has the option of supplying a negative or positive B to the circuit 96 for subtracting or adding, respectively. A sum output register of the adder/subtractor 96 is connected to the data bus 70 by twenty-nine lines. The adder/subtractor 96 is controlled by means of a circuit 97, which control circuit 97 is in turn controlled by signals from the control bus 71.

Figure 5A:
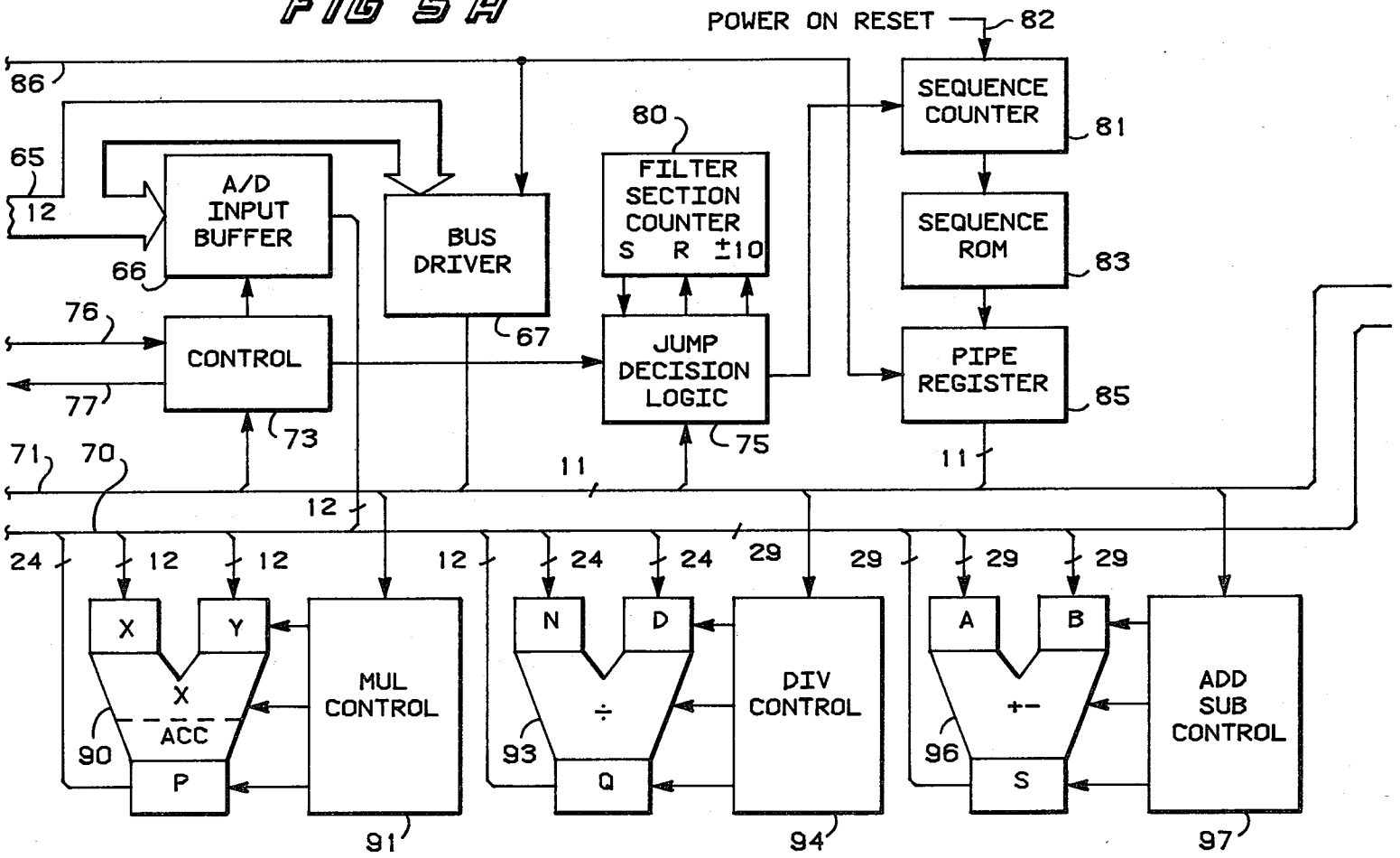
FIGS. 5A and 5B are a block diagram of voice analyzing apparatus formed on a single VLSI chip and incorporating the present invention.
Figure 5B:
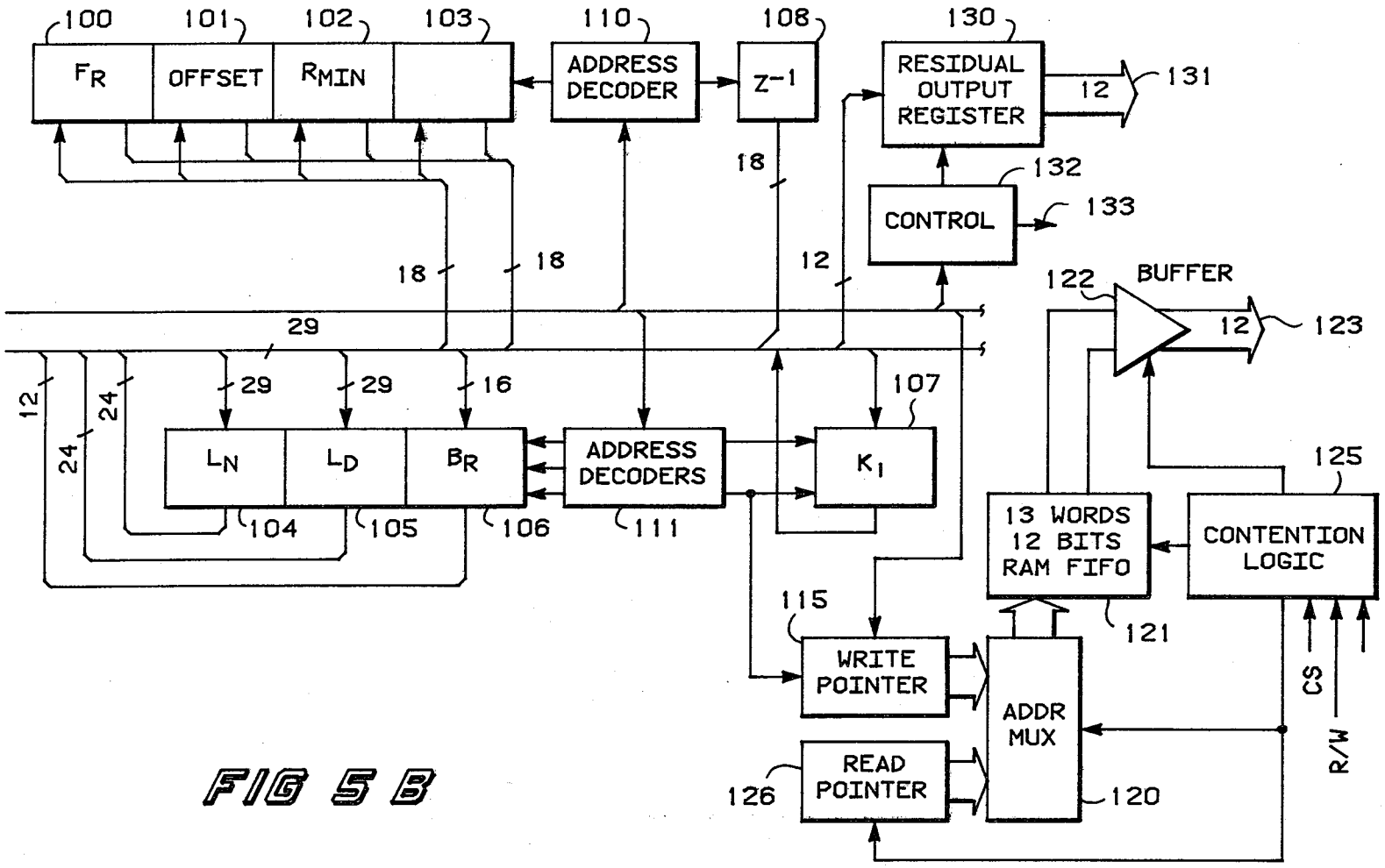

The apparatus of FIG. 5 further includes a plurality of storage units 100 through 108. Unit 100 is a temporary storage unit for storing the forward residual signal and has an input connected to the data bus 70 by eighteen lines and an output connected to the data bus 70 by eighteen lines. Storage units 101, 102, 103, and 108 are temporary storage units, the use of which will be apparent presently. Each of these storage units has an input and an output connected to the data bus by eighteen lines. Storage unit 104 is a ten word, twenty-nine bit memory for storing the low pass filtered numerator signals and has an input and an output connected to the data bus 70 by twenty-nine lines each. Storage unit 105 is a ten word, twenty-nine bit memory for storing the low pass filtered denominator signals and has an input and an output connected to the data bus 70 by twenty-nine lines each. Storage unit 106 is a ten word, sixteen bit memory for storing the backward residual signals and has an input and an output connected to the data bus 70 by sixteen lines each. Storage unit 107 is a thirteen word, sixteen bit memory for storing the correlation coefficients for each sample of data. The storage unit 107 has an input and an output connected to the data bus 70 by sixteen lines each. The storage units 100, 101, 102, 103 and 108 are controlled by an address decoder 110 having an input connected to the control bus 71. The storage units 104, 105, 106 and 107 are controlled by an address decoder 111 having an input connected to the control bus 71.

The address decoder 111 also controls a write pointer 115 associated with an address multiplexer 120. The address multiplexer 120 controls a random access memory (RAM) 121. The random access memory is a thirteen word, twelve bit first-in first-out RAM having an input connected to the data bus 70 and an output connected through a buffer 122 to an output bus 123. A contention logic circuit 125 provides control signals to the output buffer 122, the RAM 121, the address multiplexer 120 and a read pointer 126. The read pointer 126 is also associated with the address multiplexer 120. The contention logic 125 receives "sample data now" signals, read/write signals and clock signals from an external source.

In the operation of the circuitry illustrated, it is first desirable to supply a microcode specifying the operation, which microcode will be referred to presently in a step by step description of the operation.

```
        SOURCES
S       EQU 0     ONE CYCLE 29 BIT ADD OR
                  SUBTRACT OR MAGNITUDE SUBT
                  ; ADDER MUST HAVE AUTO OVFL
                    LIMIT
S/32    EQU 1
S/128   EQU 2
                  ; 3 NOT AVAILABLE
LPD     EQU 6
LPN     EQU 7
FR      EQU 8
TOFFSET EQU 9
T3      EQU 10
RMIN    EQU 11    AT BEGINNING OF FRAME RMIN
                  HELD=.999 FOR 45 SAMPLS
15/16   EQU 16    PREEMPHASIS CONSTANT
ZM1     EQU 17    PREEMPHASIS DELAY
P       EQU 20    23 BIT PRODUCT AVAILABLE 3
                  CYCLES AFTER Y*
P/2     EQU 21
BR      EQU 22
A/D     EQU 24
KI      EQU 26
2KI     EQU 27
Q/2     EQU 28
NOP     EQU 30
STE     EQU 31
      DESTINATIONS
A−,KI   EQU 0
A+      EQU 1
A−,KI,T3 EQU 2
A−      EQU 3
!A!−    EQU 4
!A!−,OUT EQU 5
                  ; 6,7 NOT AVAILABLE
−B      EQU 8     MOVE S > B NOT ALLOWED
+B      EQU 9
Y*      EQU 10    STARTS MULTIPLY
X,FR,T3 EQU 12
X,FR    EQU 13
X       EQU 14
X,Y*    EQU 15    STARTS MULTIPLY
ZM1     EQU 17    PREEMPHASIS DELAY
KI      EQU 18
BR      EQU 19
TOFFSET EQU 20
T3      EQU 21
ENAB    EQU 22
RMIN    EQU 22
LPN     EQU 24
LPD     EQU 25
N       EQU 26
D       EQU 27    STARTS DIVIDE
```

-continued

```
OUTFIFO EQU 28    WRITES TO OUTFIFO IF ENAB=1
NOP     EQU 31
      CONDITIONS
ADNR    EQU 1     A/D NOT READY
NTN     EQU 2     NOT TEN TIMES THROUGH LOOP
GE      EQU 3     JUMP IF SIGN BIT OF ADDER =0
      FIELDS
MOVE:   000000  /5:SOURCE/ /5:DESTINATION/
JUMP:   000001  /7:ADDRESS/ /3:CONDITION/
    MICROCODE
    ORG O     LOADS INTO ROM ADDRS 512
    ; THE FOLLOWING 10 MICROCODE LINES NOT IN CHIP
    ; JUST FOR FLUSHING BREADBOARD REGISTERS
    ; GENERATE A O TO FLUSH ALL REGISTERS
1           RMIN > −B
2           RMIN > A−
3           S > TOFFSET
4 LI:       TOFFSET > LPN
5           TOFFSET > LPD
6           TOFFSET > KI
7           TOFFSET > BR
8           TOFFSET > KI
9           JIF NTN L1
10 WAIT:    JIF ADNR WAIT WAIT FOR A/D CONVERSION
11            COMPLETE JIF ADNR NEXT
12 NEXT:      15/16 > X
13          A/D > Y*
14          ZM1 > −B
15          A/D > A−
16          S > A−
17          P > ZM1
18          TOFFSET > −B
19          S > X,FR,T3
20          S/128 > A+
21          S > TOFFSET       SAVE NEW DC OFFSET
22          KI > −B           KI(1)=RMS1
23          2KI > OUTFIFO
24          FR > !A!−
25          S/32 > A+
26          S > A−,KI         WRITE NEW RMS1 TO KI
27          BR > Y*           START FR*BR
28          KI > −B           KI(2) - RMS2
29          2KI > OUTFIFO
30          S/32 > A+
31          S > KI            WRITE NEW RMS2 to KI(2)
32 LOOP:    LPN > −B
33          P > A−            P=FR*BR > A−   START
                                LPN FILTER
34          BR > X,Y*         START BR*BR
35          S/32 > A+
36          S > LPN
37          P/2 > A+
38          FR > X,Y*         START FR*FR
39          NOP > NOP
40          NOP > NOP
41          P/2 > +B          START (FR**2+BR**2)/2
42          2KI > Y*          START KI*FR
43          S > A−
44          LPD > −B          START LPD FILTER
45          S/32 > A+
46          S > LPD
47          BR > A−
48          P > −B            P=K*FR > −B
49          BR > X
50          2KI > Y*          START KI*BR
51          TE > BR           PUT PREVIOUS BR ON BR
                                STACK
52          S > T3            PUT NEW BR IN T3
53          P > −B            KI*BR > −B
54          FR > A−
55          S > X,FR
56          Q/2 > A−          READ Q/2 ALSO STARTS
                                NEXT DIVIDE
57          LPN > N
58          LPD > D
59          KI > −B
60          KI > OUTFIFO
61          S/32 > A+
62          S > KI            WRITE NEW RC TO KI(3-12)
63          BR >Y*            START FR*BR FOR NEXT
                                LOOP
64 JIF   NTN LOOP
```

-continued

| | | |
|---|---|---|
| 65 | KI > −B | KI(13) IS MAGNITUDE OF RESIDUAL ENERGY |
| 66 | 2KI > OUTFIFO | |
| 67 | FR > !A!−,OUT | OUTPUT FORWARD RESIDUAL |
| 68 | S/32 > A+ | |
| 69 | S > A−,KI,T3 | NEW AVG RESID ENERGY |
| 70 | RMIN > −B | |
| 71 | NOP > NOP | |
| 72 JIF GE NTMIN | | |
| 73 | T3 > RMIN | SAVE NEWEST MINIMUM |
| 74 NTMIN:S > ENAB | | SIGN BIT TO ENAB, IF ENAB = 1 OUTFIFO LOADED FROM KI |
| 75 | JMP WAIT | THIS LINE NOT IN ROM ON CHIP ; WRAPAROUND AUTOMATIC |

In the operation of the voice analyzing apparatus illustrated in FIG. 5, refer to the above microcode wherein the numbers 1 through 75 in the column at the extreme left indicate 75 steps of operation and each of these steps will be referred to by these numbers throughout this description. Prior to application of the speech signal to the input terminal 10 of the lattice filter (FIG. 2) the speech signal is passed through a pre-emphasis circuit and a DC canceller illustrated in FIG. 1. Steps 12 through 21 accomplish the pre-emphasis and DC offset functions. Since the speech signal is a reoccurring signal varying about a reference value, the DC canceller ensures that the reference value is zero so that no DC is present and errors which could be caused by the presence of DC in the signal are eliminated. The offset signal (TOFFSET) mentioned in steps 18 and 21 of the microcode is the input signal and output signal, respectively, of the DC canceller.

In steps 1 and 2 of the microcode, any signal stored in the temporary storage unit 102 is applied to both the −B and A input registers of the adder/subtractor 96 and subtracted so that the signal at the output register is zero. The zero signal is then transferred to the temporary storage unit 101 by the third step and the zero in unit 101 is transferred to each of the storage units 104, 105, 107, 106, and 107 during steps 4 through 8, respectively. This process resets all of the storage units to zero prior to operating on the first voice sample. It will be understood that resetting the storage units causes the first pass through the process to be erroneous, as indicated by the first samples of FIGS. 4A and 4B. However subsequent passes (or cycles) through the microcode produce valid coefficients as will be seen from a further description of the microcode and the operation of the apparatus of FIG. 5. Steps 9, 10 and 11 of the microcode are a wait for the analog to digital conversion to be completed and for the twelve bit signal representative of the voice sample to be applied to the buffer 66 and bus driver 67.

Step 12 is the first step of the pre-emphasis operation and a 15/16 signal is applied to the X input register of the multiplier 90. The voice sample in digital form is applied to the Y input register and the multiplication process is started with step 13. The temporary storage register 108 operates as the one sample delay, $Z^{-1}$. The signal presently stored in the unit 108 is transferred to the −B input register of the adder/subtractor 96 during the fourteenth step. The voice sample in digital form is applied to the A input register during the fifteenth step and the difference between the two signals is available at the adder/subtractor output register. In the sixteenth step the difference signal from the output register of the adder/subtractor 96 is supplied to the A input register to begin the DC cancelling operation. The seventeenth step transfers the product from the output register of the multiplier 90 into the storage unit 108 for a one sample delay. The product will be transferred back to the adder/subtractor 96 on the fourteenth step of the next pass, or one sample later.

When the eighteenth step is performed in the apparatus the signal presently stored in the unit 101 is transferred to the −B input register of the adder/subtractor 96. The previous offset signal is subtracted from the pre-emphasized signal already in the A input register (step 16) and the difference signal is transferred, during the nineteenth step, from the output register of the adder/subtractor 96 to the X input register of the multiplier 90, the forward residual storage unit 100, and the storage unit 103, which is utilized as a first temporary storage unit in the coefficient deriving process. The twentieth step of the apparatus causes the sum signal in the output register of the adder/subtractor 96 to be shifted seven places (divide by 128) and applied to the A input register of the adder/subtractor 96 for addition to the signal in the B register (step 18). During the twenty-first step the new sum signal in the output register of the adder/subtractor 96 is transferred into the offset storage unit 101 for storage until the eighteenth step of the next pass, or series of operations. The DC cancelling is now completed and the following steps are part of the process of determining the correlation coefficient.

The twenty-second step causes the coefficient signal stored in the KI unit 107, which is a first approximation of the amplitude signal, to be transferred to the B input register of the adder/subtractor 96 for a subtraction process. The twenty-third step causes the coefficient signal (KI) to be shifted, or multiplied by 2, and transferred to the RAM 121 for storage. The twenty-fourth step causes the forward residual signal stored in the unit 100 to be transferred to the A input register of the adder/subtractor 96 and the absolute magnitude thereof to be utilized in the subtraction process. The twenty-fifth step causes the sum of the absolute magnitude of the forward residual signal (step 24) and the negative coefficient (step 22) to be shifted five places (divide by 32) and transferred to the A input of the adder/subtractor 96 for addition to the coefficient in the B input register. The twenty-sixth step causes the sum signal in the output register of the adder/subtractor 96 to be transferred to the A input register of the adder/subtractor 96 for a further subtraction process and to be put into the upper word in the eleven word stack of the storage unit 107. The sum signal of the twenty-sixth step is the final amplitude signal and is stored for later transmission.

During the twenty-seventh step the apparatus of FIG. 5 causes the backward residual signal at the bottom of the twelve word stack in the storage unit 106 to be transferred to the Y input register of the multiplier 90, which automatically starts the multiplication process since the X input register contains the forward residual signal from the nineteenth step of the process. The twenty-eighth step causes the coefficient stored in the storage unit 107 to be transferred to the B input register of the adder/subtractor 96 and the negative thereof to be added to the signal stored in the A input register during step 26. Step 29 causes the coefficient signal ($K_I$) to be shifted, or multiplied by 2, and transferred to the RAM 121 for storage. Step 30 causes the sum signal in the output register of the adder/subtractor to be shifted five places (divide by 32) and put into the A input register of the adder/subtractor 96 for addition to the signal already in the B input register (step 28). The sum signal in the output register of the adder/subtractor 96 is transferred back into the correct word slot of storage unit 107 during the thirty-first step.

The thirty-second step of the microcode causes the low pass numerator signal stored in the unit 104 to be transferred to the B input register of the adder/subtractor 96 for a subtraction process. The thirty-third step completes the multiplication of the forward residual signal and backward residual signal started in step 27 and transfers the product signal from the output register of the multiplier 90 to the A input register of the adder/-subtractor 96 to start the subtraction process. Referring to FIG. 3, the step 33 in the microcode starts the filtering process of the numerator signal from the multiplier 45.

The thirty-fourth step transfers the backward residual signal from the storage unit 106 to both the X and Y input registers of the multiplier 90, which automatically starts the multiplication process. The thirty-fifth step transfers a sum signal shifted five places (divided by 32) from the output register of the adder/subtractor 96 to the A input register for addition to the signal in the B register (step 32). The sum signal from the output register of the adder/subtractor 96 is transferred by the thirty-sixth step to the low pass filtered numerator storage unit 104. This basically completes the filtering of the low pass numerator signal, except that the one sample time delay required in the filtering process is provided by the storage unit 104. It will be understood by those skilled in the art that the signals are supplied to and removed from the word stack in the storage unit 104, and all of the other storage units during the process, so as to provide a one sample delay of the signals during the operation. This simply means that the low pass numerator signal, for example, stored during the first cycle through the microcode is used as the delayed low pass numerator signal during the second cycle through the microcode.

The thirty-seventh step causes the product of the multiplication process started with the thirty-fourth step and shifted one place (divide by 2) to be transferred to the A input register of the adder/subtractor 96 for an addition process. The thirty-eighth step transfers the forward residual signal stored in the unit 100 to both the X and Y input registers of the multiplier 90, which starts the multiplication process. Steps 39 and 40 simply continue the multiplication process and no other sequencing is performed during these steps. The forty-first step transfers the product shifted one place (divided by 2) from the output register of the multiplier 90 to the B input register of the adder/subtractor 96 for addition to the signal in the A register (step 37). The signal being produced by the forty-first step of the microcode is equivalent to the output signal of the multiplier 53 in FIG. 3.

The forty-second step transfers a shifted coefficient signal (multiplied by 2) from the storage unit 107 to the Y input register of the multiplier 90 and starts the multiplication process. The step 42 is represented by the multiplier 22 in FIG. 2. The sum signal in the output register of the adder/subtractor 96 is transferred during the forty-third step to the A input register of the adder/-subtractor 96 for a subtraction process. The forty-fourth step transfers the low pass filtered denominator signal from the storage unit 105 to the B input register of the adder/subtractor 96 for subtraction from the signal supplied to the A input register during step 43. The step 44 starts the low pass filtering of the denominator signal, represented by filter 55 in FIG. 3. Step 45 causes the sum signal in the output register of the adder/subtractor 96, which signal has been shifted five places (divided by 32), to be transferred to the A input register of the adder/subtractor 96 for addition to the signal in the B input register (step 44). Step 46 causes the sum signal in the output register of the adder/subtractor 96 to be transferred back into the storage unit 105. This is the low pass filtered denominator signal, represented as the output of the filter 55 in FIG. 3.

Step 47 causes the backward residual signal stored in the unit 106 to be transferred to the A input register of the adder/subtractor 96 for a subtraction process. The product output signal from the multiplier 90, produced by the multiplication process started in step 42, is transferred during step 48 to the B input register of the adder/subtractor 96 for subtraction from the signal in the A register (step 47). Step 49 causes the backward residual signal stored in the unit 106 to be transferred to the X input register of the multiplier 90. Step 50 causes the coefficient signal, shifted one place (multiplied by 2) to be transferred from the storage unit 107 to the Y input register of the multiplier 90 and the multiplication process started. This multiplication process is represented by the multiplier 21 in FIG. 2. The fifty-first step causes the signal stored in the unit 102 (step 19) to be transferred into the backward residual storage unit 106, which signal represents the one sample time delayed signal out of the delay network 25 in FIG. 2 and is the backward residual signal which will be put into the next stage of the lattice filter.

The fifty-second step causes the sum signal in the output register of the adder/subtractor 96 (subtraction process started in steps 47 and 48) to be transferred to the storage unit 103. This is the new backward residual signal, represented by the output of the combining circuit 20 of FIG. 2, to be delayed one sample time.

The fifty-third step transfers the product signal from the output register of the multiplier 90 (multiplication process from step 50) to be transferred to the B input register of the adder/subtractor 96 for a subtraction process. Step 54 transfers the forward residual signal from the storage unit 100 to the A input register of the adder/subtractor 96 and starts the subtraction process. The sum signal in the output register of the adder/subtractor 96 is transferred by the fifty-fifth step to the X input register of the multiplier 90 and the forward residual storage unit 100. This output of the adder/subtractor 96 is the forward residual signal which will be utilized in the second cycle of the microcode and represents the forward residual signal, $F_{R2}$ supplied to the second stage of the lattice filter.

The fifty-sixth step causes a quotient signal, shifted one place (divide by 2), in the output register of divider 93 to be transferred to the A input register of the adder/subtractor 96. This is represented by the output of the divider 60 supplied to the filter 61 in FIG. 3. Step 57 causes the low pass numerator signal stored in the unit 104 to be transferred to the numerator input register of the divider 93. Step 58 causes the low pass denominator signal stored in the unit 105 to be transferred to the denominator input register of the divider 93 and the next division process to be started. The fifty-ninth step causes the coefficient stored in the unit 107 to be transferred to the B input register of the adder/subtractor 96 and a subtraction process to be started. This step is the beginning of the filtering of the quotient signal, represented by the filter 61 in FIG. 3. Step 60 causes the coefficient stored in the unit 107 to be transferred to the RAM 121 for storage and possible future transmission. The sixty-first step causes the sum signal in the output of the adder/subtractor 96, shifted five places (divide by 32), to be transferred to the A input of the adder/subtractor 96 for addition to the signal in the B input register (step 59). The sum signal in the output register of the adder/subtractor 96, which is the first correlation coefficient, is transferred during the step 62 to the coefficient storage unit 107.

The sixty-third step transfers the backward residual signal from the storage unit 106 to the Y input register of the multiplier 90 and starts the multiplication process represented by the multiplier 45 of FIG. 3 for the next cycle or loop of the microcode. The sixty-fourth step interrogates the jump decision logic 75 to determine if the microcode has been cycled ten times to represent the ten stages of the lattice filter. If the microcode has not been cycled ten times it returns to step 12 for the next cycle. When ten microcode cycles have been completed and ten correlation coefficients are stored in the storage unit 107, the step designated as 65 in the microcode causes the final coefficient stored in the unit 107 to be transferred to the B input register of the adder/subtractor 96 for a subtraction process. Step 66 transfers the coefficient stored in the storage unit 107, and shifted one place (multiplied by 2) to the RAM 121. The step 67 transfers the forward residual signal from the storage unit 100 to the A input register of the adder/subtractor 96 and the signal in the B register is subtracted from the absolute magnitude of the signal in the A register. Simultaneously, the step 67 causes the forward residual signal from the storage unit 100 to be transferred to a residual output register 130 as an output signal. The register 130 has a twelve line output bus 131 connected thereto and provides a residual output from the apparatus. The register 130 is controlled by a control circuit 132 which is controlled in turn by signals from the control bus 71 and supplies a signal on an output line 133 when the residual output is being transferred.

The sum signal in the output register of the adder/-subtractor 96 is shifted five places (divide by 32) and transferred into the A input register of the adder/subtractor by the sixty-eighth step. The signals in the A and B registers are added and the sum signal in the output register of the adder/subtractor 96 is transferred by the sixty-ninth step to the A input for a subtraction process, to the coefficient storage unit 107 and to the first storage unit 103. This sum signal represents a new average residual energy. The previous low residual energy which may be stored in the temporary register 102, for example, is transferred to the B input register of the adder/subtractor 96 during the seventieth step for comparison with the new average residual energy. If the new average residual energy signal is greater than the previous minimum, the previous minimum remains in storage and is not altered until the next voice sample. The seventy-second step jumps the entire apparatus back to step 10 if the sum signal in the output register of the adder/subtractor 96 is equal to zero (in the seventy-first step). If the sum signal is not equal to zero the seventy-third step causes the new average residual energy signal stored in the storage unit 103 to be transferred into the storage unit 102 as a new minimum. If the new average residual energy signal is lower than the previous minimum the seventy-fourth step enables the RAM 121 and its associated circuitry so that the ten coefficients stored in the storage unit 107 are transferred to the RAM 121. The seventy-fifth step then causes the apparatus to jump back to step 10 and start the process again for the next speech sample.

The apparatus continues to compare residual energy signals over an entire frame, or 180 samples. Subsequent to the final sample in the frame the amplitude signal, the lowest or minimum residual energy signal (excitation) and the corresponding ten correlation coefficients are transmitted from the apparatus by way of busses 123 and 131. These signals are used in remote equipment to reconstruct the original voice.

Figure 6:
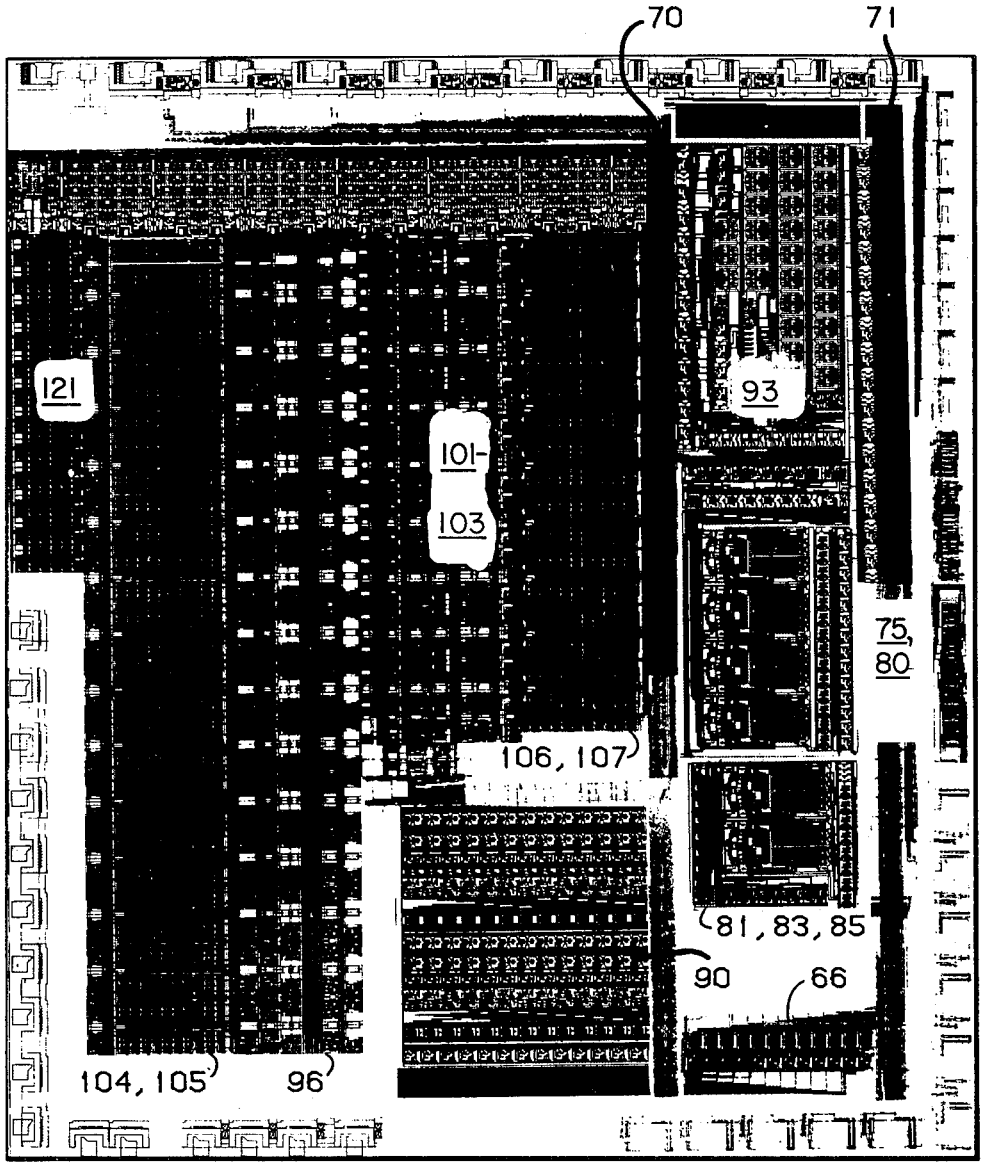
FIG. 6 is a plan view of a semiconductor chip containing the analyzer of FIG. 5, showing the metal mask or metal pattern.

While a specific sequence of operations is disclosed by the above microcode, it will be understood by those skilled in the art that various minor modifications might be included. The specific microcode described is utilized because it is believed to be the simplest and shortest process that can be performed with the apparatus illustrated. It will of course be understood that modifications in sample rates, steps, etc., could be incorporated and additional time gained, through the use of fewer speech samples for example, might be utilized to expand the program. Basically, the use of the components disclosed and the proper sequencing thereof allows the entire voice analyzing apparatus to be included on a single semiconductor chip which provides the previously described advantages. FIG. 6 illustrates a specific plan view of the metal mask for the integrated circuit containing the voice analyzing apparatus of FIG. 5. The various areas corresponding to the components of FIG. 5 are numbered with similar characters to indicate their function.

Thus, improved voice analyzing apparatus is disclosed which is capable of providing correlation coefficients, residual energy values, and amplitude signals for linear predictive coding of voice signals. The apparatus and methods disclosed include several improvements which allow the voice analyzing apparatus to be formed on a single semiconductor chip, which in turn provides all of the advantages described above. While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

I claim:

1. Voice analyzing apparatus including N partial correlation coefficient determining digital circuits for incorporation into an all-zero lattice digital filter so that each circuit receives a different pair of N pairs of forward residual and backward residual signals and provides a different one of N partial correlation coefficients, each of said circuits comprising:

(a) digital multiplying means for receiving a pair of forward residual and backward residual signals and providing a first output signal representative of the forward residual signal multiplied by the backward residual signal, a second output signal representative of the forward residual signal multiplied by itself, and a third output signal representative of the backward residual signal multiplied by itself;

(b) signal combining means connected to receive the second and third output signals from said multiplying means for providing a sum signal representative of the sum of the second and third output signals;

(c) digital filtering means connected to receive the first output signal for providing a numerator signal and connected to receive the sum signal from said combining means for providing a denominator signal;

(d) digital dividing means connected to receive the numerator and denominator signals for providing an output signal representative of the quotient of the two received signals; and (e) digital filtering means connected to receive the output signal of said dividing means for providing an output signal representative of one of the N correlation coefficients.

2. Apparatus as claimed in claim 1 wherein the digital multiplying means includes a single digital multiplier and the apparatus further includes sequencing circuitry connected to supply the forward residual and backward residual signals in a predetermined sequence to said multiplier to provide the first, second and third output signals in a predetermined sequence.

3. Apparatus as claimed in claim 2 wherein both of the digital filtering means include a single digital filter and the sequencing circuitry is further connected to supply the first output signal, the sum signal from the combining means and the output signal from the dividing means in a predetermined sequence to said filter to provide the numerator signal, the denominator signal, and the output signal representative of one of the N correlation coefficients in a predetermined sequence.

4. Apparatus as claimed in claim 3 wherein the sequencing circuitry is further connected to supply all of the N pairs of forward residual and backward residual signals to the multiplier in a predetermined sequence to provide all N correlation coefficients in a predetermined sequence.

5. Apparatus as claimed in claim 4 wherein the apparatus is formed on a single semiconductor substrate as an integrated circuit.

6. Voice analyzing apparatus including an all-zero lattice digital filter formed of N stages with each stage being connected to receive a different pair of N pairs of forward residual and backward residual signals and each stage producing a different pair of the N pairs, each stage comprising:

(a) a partial correlation coefficient determining digital circuit including (1) digital multiplying means for receiving a pair of forward residual and backward residual signals and providing a first output signal representative of the forward residual signal multiplied by the backward residual signal, a second output signal representative of the forward residual signal multiplied by itself, and a third output signal representative of the backward residual signal multiplied by itself, (2) signal combining means connected to receive the second and third output signals from said multiplying means for providing a sum signal representative of the sum of the second and third output signals, (3) digital filtering means connected to receive the first output signal for providing a numerator signal and connected to receive the sum signal from said combining means for providing a denominator signal, (4) digital dividing means connected to receive the numerator and denominator signals for providing an output signal representative of the quotient of the two received signals, and (5) digital filtering means connected to receive the output signal of said dividing means for providing a filtered signal representative of one of the N correlation coefficients;

(b) first and second digital multiplying means connected to receive the forward residual and backward residual signals, respectively, and each further connected to receive the filtered signal for providing a first product signal representative of the product of the forward residual signal and the filtered signal and a second product signal representative of the backward residual signal and the filtered signal;

(c) first combining means connected to receive the forward residual signal and the second product signal for providing a forward residual output signal which sequentially follows the forward residual signal applied to said first combining means; and (d) second combining means including delay means connected to receive the backward residual signal and the first product signal for providing a backward residual output signal which sequentially follows the backward residual signal applied to said second combining means.

7. Apparatus as claimed in claim 6 wherein the digital multiplying means of the coefficient determining circuit and the first and second digital multiplying means include a single digital multiplier and the apparatus further includes sequencing circuitry connected to supply the forward residual signal, the backward residual signal, and the filtered signal in a predetermined sequence to said multiplier to provide the first, second, and third output signals and the first and second product signals in a predetermined sequence.

8. Apparatus as claimed in claim 7 wherein the signal combining means of the coefficient determining circuit and the first and second combining means include a single add/subtract device and the sequencing circuitry is further connected to supply the second and third output signals, the forward and backward residual signals, and the first and second product signals in a predetermined sequence to said add/subtract device to provide the sum signal, the forward residual output signal, and the backward residual output signal in a predetermined sequence.

9. Apparatus as claimed in claim 8 wherein the two digital filtering means of the coefficient determining circuit include a single digital filter and the sequencing circuitry is further connected to supply the first output signal, the sum signal and the output signal from the dividing means in a predetermined sequence to said filter to provide the numerator signal, the denominator signal, and the output signal representative of one of the N correlation coefficients in a predetermined sequence.

10. Apparatus as claimed in claim 7 wherein the sequencing circuitry is further connected to supply all of the N pairs of forward residual and backward residual signals to the stage in a predetermined sequence to provide all N correlation coefficients in a predetermined sequence.

11. Apparatus as claimed in claim 10 wherein the apparatus is formed on a single semiconductor substrate as an integrated circuit.

12. Apparatus as claimed in claim 11 wherein the integrated circuit includes test input means for supplying test signals to said integrated circuit and ascertaining the correct operation thereof.

13. A method of analyzing human speech in the form of a digital signal, $F_R$, to provide N correlation coefficients, $K_1$ through $K_N$, comprising the steps of:

providing a multiplier having X and Y inputs, a product output, and a divide by C or shifted product output, a divider having numerator and denominator inputs and a multiply by D or shifted quotient output, an adder/subtractor having A, B and −B inputs, a combined output and a divide by E or shifted combined output, and a plurality of temporary storage units each reset to zero prior to starting the method;

inputting $F_R$ into the X input of the multiplier, into an $F_R$ temporary storage unit, and into a first temporary storage unit;

inputting a signal, $B_R$, from a $B_R$ temporary storage unit into the Y input of the multiplier and initiating a multiplication process;

inputting a signal, $L_N$, from a $L_N$ temporary storage unit into the B and −B inputs of the adder/subtractor;

inputting a product output ($F_R.B_R$) from the multiplier into the A input of the adder/subtractor and initiating a subtraction process;

inputting the signal $B_R$ from the $B_R$ storage unit into the X and Y inputs of the multiplier and starting the multiplying process;

inputting a shifted output of the adder/subtractor into the A input of the adder/subtractor and initiating an addition process;

storing a combined output from the adder/subtractor in the $L_N$ temporary storage unit;

inputting a shifted product output ($B_R.B_R/C$) into the A input of the adder/subtractor;

inputting the signal $F_R$ from the $F_R$ storage unit into the X and Y inputs of the multiplier and starting the multiplication process;

inputting a shifted product output ($F_R.F_R/C$) into the B input of the adder/subtractor and initiating an addition process;

inputting a signal, $K_I$, from a N position $K_I$ storage unit into the Y input of the multiplier and starting the multiplication process;

inputting a combined output from the adder/subtractor into the A input of the adder/subtractor;

inputting a signal, $L_D$, from a $L_D$ temporary storage unit into the B and −B inputs of the adder/subtractor and initiating a subtraction process;

inputting a shifted combined output from the adder/subtractor into the A input of the adder/subtractor and initiating an addition process;

inputting a combined output from the adder/subtractor into the $L_D$ temporary storage unit;

inputting the signal $B_R$ from the $B_R$ temporary storage unit into the A input of the adder/subtractor;

inputting a product output ($K_I.F_R$) from the multiplier into the −B input of the adder/subtractor and initiating a subtracting process;

inputting the signal $B_R$ from the $B_R$ temporary storage unit into the X input of the multiplier;

inputting the signal $K_I$ from the $K_I$ temporary storage unit into the Y input of the multiplier and initiating a multiplication process;

inputting the signal from the first temporary storage unit into the $B_R$ temporary storage unit;

inputting a combined output from the adder/subtractor into the first temporary storage unit;

inputting a product output ($K_I.B_R$) from the multiplier into the −B input of the adder/subtractor;

inputting the signal $F_R$ from the $F_R$ storage unit into the A input of the adder/subtractor and initiating a subtraction process;

inputting a combined output from the adder/subtractor into the X input of the multiplier and the $F_R$ storage unit;

inputting a shifted quotient outputs from the divider ($DL_D/L_N$) into the A input of the adder/subtractor;

inputting the signal $L_N$ from the $L_N$ storage unit into the numerator input of the divider;

inputting the signal $L_D$ from the $L_D$ storage unit into the denominator input of the divider and initiating a divide process;

inputting the signal $K_I$ from the $K_I$ storage unit into the B and −B inputs of the adder/subtractor and initiating a subtraction process;

inputting a shifted combined output from the adder/subtractor into the A input of the adder/subtractor and initiating an addition process;

inputting a combined output from the adder/subtractor into the $K_I$ storage unit;

inputting the signal $B_R$ from the $B_R$ storage unit into the Y input of the multiplier and initiating a multiplication process; and returning to step 2 and repeating the steps N times using $F_R$ from the $F_R$ storage unit to provided N $K_I$'s in the storage unit.

14. A method as claimed in claim 12 including in addition the steps of developing N $K_I$'s for each sample of a plurality of samples of the human speech, comparing each new set of N $K_I$'s to a previously stored set, selecting the more accurate set of the compared sets, and storing the selected set for the next comparison.

15. In a process of analyzing human speech utilizing an all-zero lattice filter wherein the forward residual signal, $F_R$, and backward residual signal, $B_R$, inputted to each of the N stages of the filter are utilized to derive a partial correlation coefficient for each of the N stages, a method of deriving the partial correlation coefficient from the signals $F_R$ and $B_R$ comprising the steps of:

(a) multiplying the signals $F_R$ and $B_R$ to produce a first product;

(b) filtering the first product to produce a numerator;

(c) multiplying the signal $F_R$ by itself to produce a second product;

(d) multiplying the signal $B_R$ by itself to produce a third product;

(e) combining the second and third products to produce a sum signal of the products having a magnitude approximately one half of the magnitude of the sum of the two products;

(f) filtering the sum signal to produce a denominator;

(g) dividing the numerator by the denominator to produce a quotient; and (h) filtering the quotient to produce the partial correlation coefficient.

* * * * *